US006497627B2

(12) United States Patent
Collins

(10) Patent No.: US 6,497,627 B2
(45) Date of Patent: Dec. 24, 2002

(54) GOLF SWING INSTRUCTIONAL DEVICE AND METHOD

(76) Inventor: Michael D. Collins, 304 Old Landing Rd., Rehobeth, DE (US) 19971

( * ) Notice: Subject to any disclaimer, the term of this patent is extended or adjusted under 35 U.S.C. 154(b) by 0 days.

(21) Appl. No.: 09/818,506

(22) Filed: Mar. 28, 2001

(65) Prior Publication Data

US 2002/0142854 A1 Oct. 3, 2002

(51) Int. Cl.[7] ..... A63B 69/36

(52) U.S. Cl. ..... 473/264; 473/257; 473/266; 473/271

(58) Field of Search ..... 473/257, 258, 473/269, 272, 277, 264, 271, 216, 227

(56) References Cited

U.S. PATENT DOCUMENTS

| | | | | |
|---|---|---|---|---|
| 1,936,143 A | | 11/1933 | Shea | |
| 3,623,733 A | | 11/1971 | Cavanaugh | |
| 3,940,144 A | | 2/1976 | Dickie | |
| 4,659,084 A | | 4/1987 | Vuick | |
| 4,758,001 A | | 7/1988 | Otting et al. | |
| 4,949,974 A | * | 8/1990 | Bellagamba | 473/216 |
| 4,998,731 A | * | 3/1991 | Bowen | 473/271 |
| 5,221,089 A | | 6/1993 | Barrett | |
| 5,255,921 A | | 10/1993 | Spence | |
| 5,634,858 A | | 6/1997 | Bellagamba | |
| 5,707,300 A | | 1/1998 | May et al. | |
| 5,769,732 A | | 6/1998 | O'Neal | |
| 5,830,079 A | | 11/1998 | Hudson | |

* cited by examiner

*Primary Examiner*—Paul T. Sewell
*Assistant Examiner*—M. Chambers
(74) *Attorney, Agent, or Firm*—Hall, Priddy, Myers & Vande Sande

(57) ABSTRACT

A golf swing instructional cage for teaching a quiet lower body swing, employs a minimum of three body constraints: a rear constraint, a forward upper leg lateral constraint and a constraint at the rear of the rearward knee area such that when the golfer is located in the proper initial swing position proximal the rear constraint and knee area restraint and a short laterally spaced distance from the forward upper leg lateral constraint, avoidance of contact with the spaced forward upper leg lateral constraint during the golf swing instructs in quiet lower body control. Optionally a laterally spaced rear upper leg lateral restraint is also provided which, by avoidance of contact during the golf swing further instructs in additional quiet lower body control.

19 Claims, 4 Drawing Sheets

Fig.1
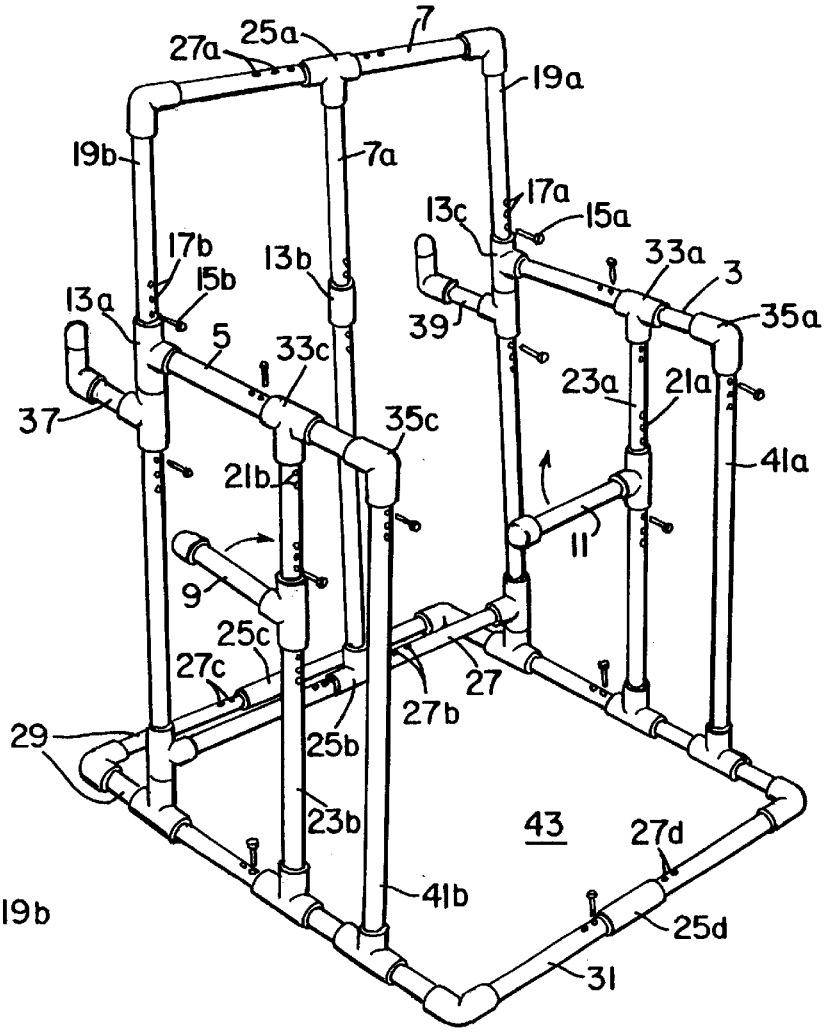
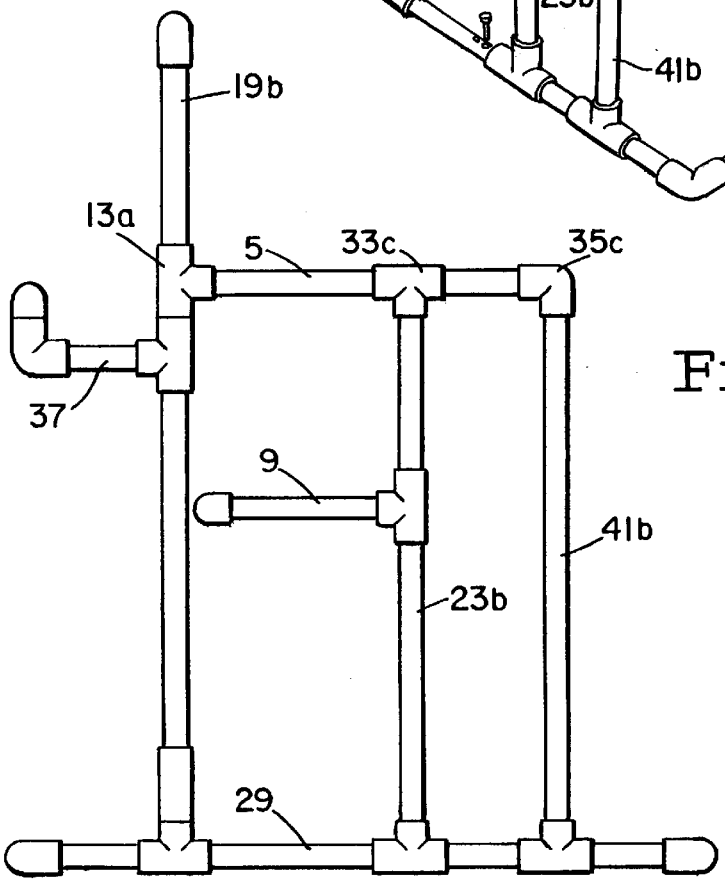
Fig.2

Fig.5
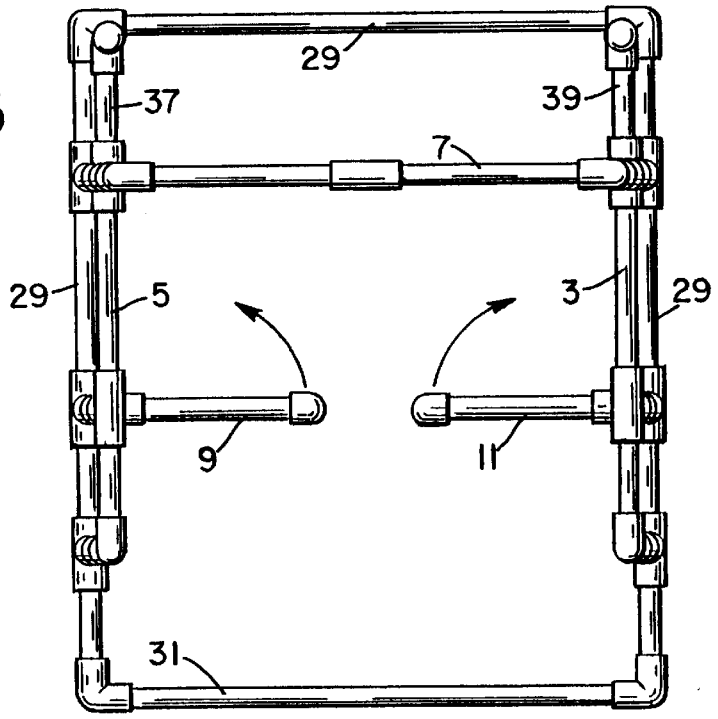
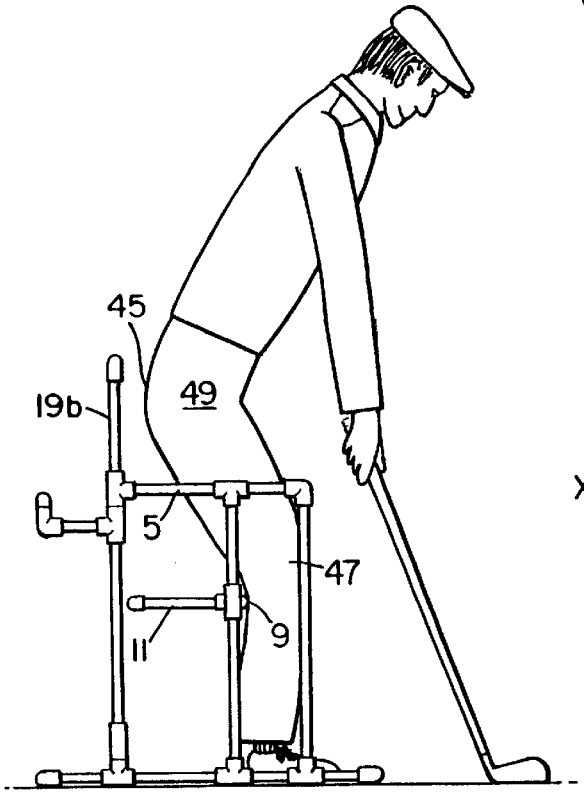
Fig.6
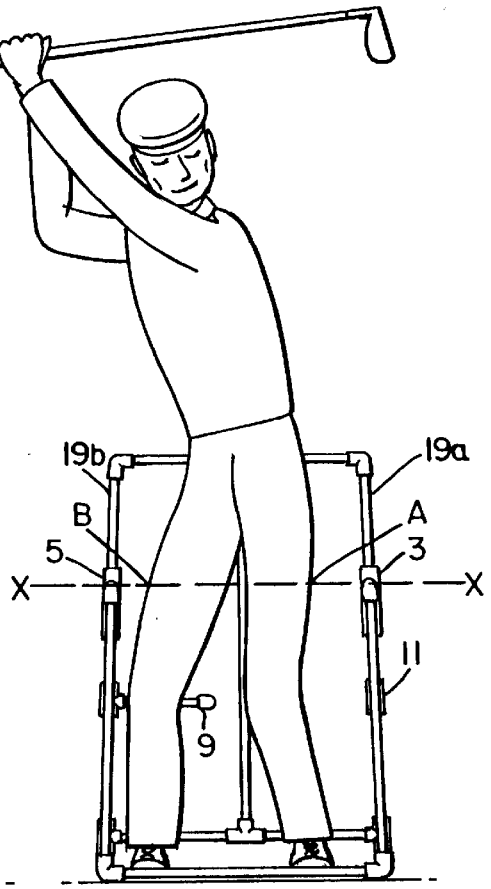
Fig.7

GOLF SWING INSTRUCTIONAL DEVICE AND METHOD

This invention relates to a golf swing instructional device and a method of teaching a golf swing using such a device. More particularly, this invention relates to a device and method for teaching a golfer a swing which minimizes lower body lateral motion during the golf swing.

BACKGROUND OF THE INVENTION

The game of golf has been played and refined by amateur and professional alike for decades. During this time the golf swing has been constantly evolving until currently, given the type of ball, equipment and course design now commonly provided, the modern golf swing consists of what is descriptively, and accurately referred to as employing a "quiet lower body". Generally speaking this term means that in effecting a proper golf swing from an initial proper posture, whether a driver, a midiron or a wedge etc. is being used, lateral movement of the hips and upper legs should be minimized.

Minimizing lateral movement of the lower body normally must be taught because it is not a normal act performed by a beginner golfer who often sways and looses a portion of his balance when trying to hit the ball. While proper rotation of the hips, in this regard, is a central feature of a good golf swing, excessive lateral rearward sway upon club take-back at the beginning of the swing and/or excessive lateral forward sway of the hips during the downswing results in bad timing, loss of balance and finally a weakened, poor shot.

While several teaching professionals now manually instruct their students to employ a "quiet lower body" as described above, they are often less than fully successful due to the difficulty of the pupil carrying out such an oral instruction. Moreover, while numerous teaching aids for developing a golf swing have been invented and developed over the years, none is known to have successfully addressed the specific ability to improve the teaching professional's ability to teach and have his pupil learn a proper "quiet lower body" golf swing; nor to address the ability of the golfer to learn and/or to practice such a "quiet lower body" swing on his/her own.

In view of the above it is apparent that there exists a need in the art for a device and method which effectively addresses the ability of the golfer to learn the modern "quiet lower body" golf swing, or stated another way, which teaches the golfer to minimize at least forward lateral sway and preferably both rearward and forward lateral sway.

SUMMARY OF THE INVENTION

Generally speaking this invention fulfills the above needs in the art by providing a golf swing instructional device comprising a frame member which includes at least three points of constraint for minimizing lateral movement of a golfer's lower body within preselected limits during a golf swing when the golfer is located within the frame member and as the golfer progresses through the golf swing. The points of constraint employed include:

a) a rear point of constraint;

b) a lower point of constraint; and c) a forward lateral point of constraint.

The points of constraint are located each with respect to the other such that when the golfer assumes a proper posture to initiate his golf swing, his buttocks is located proximal the rear point of constraint and simultaneously therewith the lower point of constraint is located proximal a rear area of the golfer's rearward leg at a point located between his knee and upper calf and the forward lateral point of constraint is spaced a preselected lateral distance at a point located in a horizontal plane with the golfer's upper forward leg. In such a position, when the golfer properly executes a golf swing when so positioned, no portion of the golfer's upper forward leg between the golfer's forward hip and forward knee will contact the forward lateral point of constraint.

In certain preferred embodiments the device further includes a rearward lateral point of constraint which is located with respect to the other points of constraint such that simultaneously with the golfer being in his/her proper swing posture (position) and located as aforesaid with respect to the other points of constraint, the rearward lateral point of constraint is spaced a preselected lateral distance at a point located in a horizontal plane from the golfer's upper rearward leg; such that a properly executed golf swing by the golfer will cause no portion of his/her rearward upper leg between his/her rearward hip and rearward knee to contact the rearward lateral point of constraint.

This invention, in fulfilling the above needs in the art, also provides a method of instructing a golfer to perform a proper golf swing with minimized lower body lateral motion, the steps including:

a) providing at least three constraints for positioning a golfer's body in relation thereto such that when so positioned the golfer assumes the proper posture for initiating a golf swing, the constraints including a rear constraint, a lower constraint, and a forward lateral constraint;

b) positioning the golfer in the aforesaid proper posture such that his buttocks is located proximal the rear constraint, an area at the rear of his rearward leg between his knee and upper calf is located proximal the lower constraint and the forward lateral surface of his upper forward leg at a point between the knee and hip of the forward leg is spaced a preselected distance from the forward lateral constraint; and c) performing a golf swing by the golfer when in the aforesaid proper posture without contacting the forward lateral constraint at any time throughout the swing thereby to have engaged in a golf swing with the aforesaid minimized lower body motion.

In certain preferred embodiments of this method, there is further provided a rearward lateral constraint and the method further includes positioning the golfer such that the rearward lateral surface of his rearward upper leg at a point between his hip and knee is spaced a preselected distance from the rearward lateral constraint. When, then, the golf swing is performed with the golfer so positioned, and in the proper posture, the upper rearward leg of the golfer does not contract the rearward lateral constraint at any time throughout the swing.

This invention will now be described with respect to certain embodiments thereof as illustrated in the following drawings wherein:

IN THE DRAWINGS

FIG. 1 is a three dimensional perspective view of an embodiment of a teaching device according to this invention.

FIG. 2 is a right side elevational view of the embodiment of FIG. 1 but without the adjustable features shown.

FIG. 5 is a top plan view of the embodiment of FIG. 2.

FIG. 6 is a right side schematic view of a golfer located in a proper pre-swing posture and position within the device of FIG. 2.

FIG. 7 is a front schematic view of the same golfer and device as shown in FIG. 6, but with the golfer shown at the top of his backswing.

DETAILED DESCRIPTION OF CERTAIN EMBODIMENTS

Figure 3:
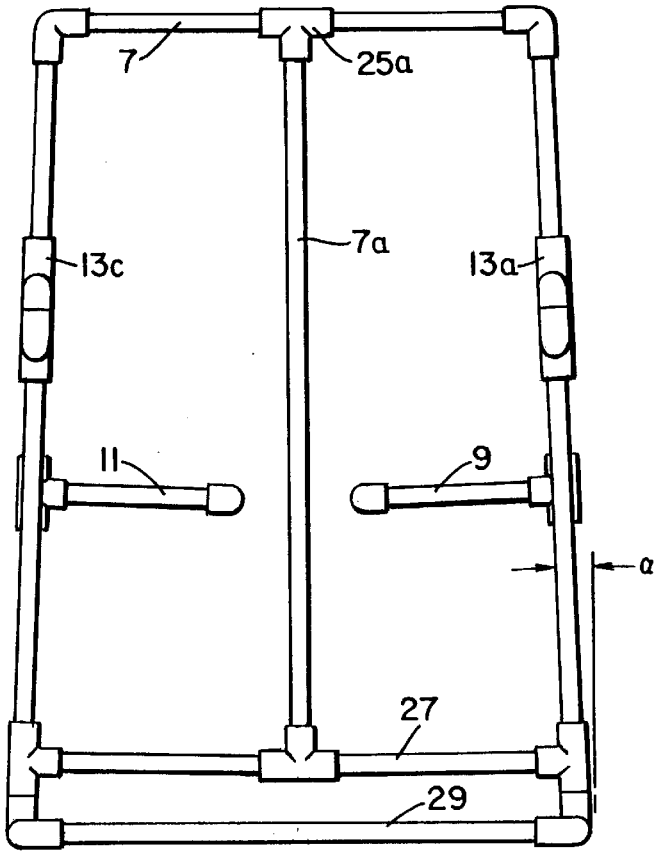
FIG. 3 is a rear elevational view of the embodiment of FIG. 2.
Figure 4:
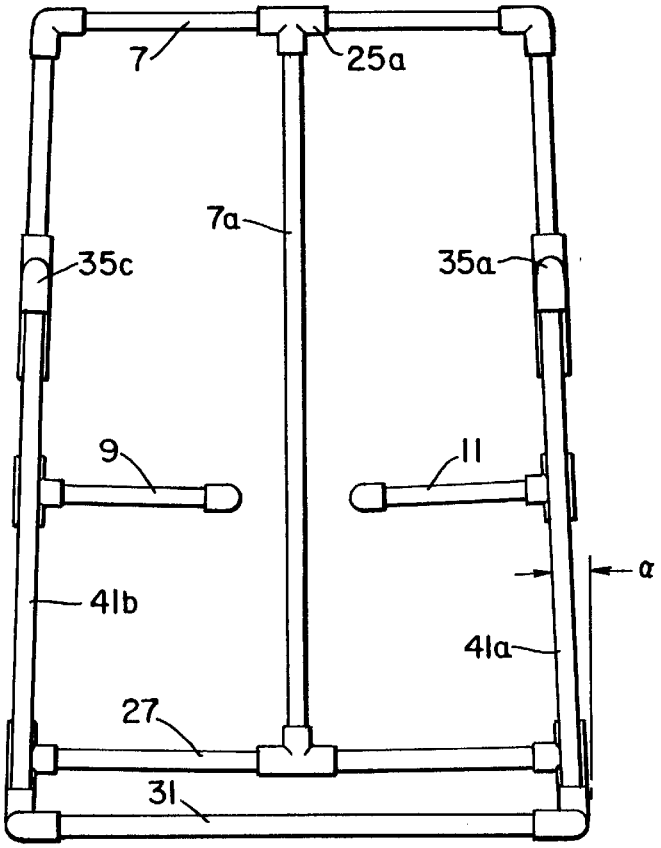
FIG. 4 is a front elevational view of the embodiment of FIG. 2.

With reference to FIGS. 1–4, there is illustrated a teaching frame 1 comprised of (for a right handed, swinging golfer) a forward constraint bar 3, an optional rearward constraint bar 5, a rear constraint bar 7 or 7*a*, pivotal right lower constraint bar 9, and pivotal left lower constraint bar 11. If the golfer within frame 1 is a left handed swinging golfer, bar 3 would be the rearward constraint and bar 5 would be the forward constraint. As will be seen in further figures described below, lower constraint 11 has been pivoted into position (and lower constraint 9 has been pivoted out of position) so as to be located in the rear area of the rear leg of a left handed swinging golfer, between his knee and calf. By swinging lower constraints 9, 11 in the direction of the arrows shown, the device is reset for a right handed swinging golfer such that constraint 11 is moved out of the way while constraint 9 is now moved to a position proximal the area between the right handed swinging golfer's rear knee and calf and preferably so as to just touch his leg directly at the rear of the golfer's knee when the golfer assumes the proper initial stance. In this way a single device 1 is applicable to both right handed swinging (e.g., FIGS. 6–7) and left handed swinging golfers.

As can be seen, the device illustrated in FIGS. 1–4 includes at least three constraints:

a) a rear constraint (7 or 7*a*)

b) a lower constraint (9 or 11)

c) a forward constraint (3 or 5).

When one forward constraint (e.g. 3) is provided, optionally, the other (e.g. 5) may also be provided so as to serve as a rearward constraint bar, thereby providing a constraint against oversway in both the forward and rearward directions during the swing. The rear constraint, in practice, may consist of bar 7 or bar 7*a* or both (for a right handed golfer), depending on the size of the golfer being instructed.

In this respect it will be recognized that the important feature of this invention is that it provides "points" of constraint for both initially locating the golfer in a proper posture to initiate his/her swing and for teaching him/her through noncontact with the forward and rear constraints how to maintain proper swing balance. In the preferred embodiment this is done by initially maintaining (focusing) the weight of the golfer during backswing on the ball of the big toe and inner side of the rear foot (so as not to oversway during take back) and to maintain balance throughout the swing so as to allow for weight shift to the front foot (and leg) without forward oversway. In achieving this desired result, the golfer will have achieved what is generally meant in the art as a "quiet lower body". Because, then, it is the positioning of these points of constraint which become important, rather than the actual structural members used to present them, it will be recognized that numerous different structures and/or apparatus may be created to present and locate them. The device shown in the figures is merely one convenient manner of doing so.

Frame 1 is this respect may be constructed of any convenient material and can be made adjustable if desired to accommodate different size golfers, for more precise teaching. For example, as illustrated herein the various members of frame 1 may be made of standard PVC piping (e.g., 1" PVC 450 P.S.I. water pipe) whose key joints may be left slidable for adjustment as to size. One adjustable technique (among many possible) is shown in FIG. 1 wherein the joints 13*a, b* and c are made slidable while vertical bars 19*a, b* are provided with adjusting holes 17*a, b* and pins 15*a, b*, respectively. In this manner, if bar 7 is to be used as the rear constraint, its height can be easily adjusted and secured by pins 15*a, b* located in the appropriate respective holes 17*a, b*. Similar adjusting holes 21*a, b* may be provided with inserted pins (not shown) in bars 23*a, b* for adjusting the height of lower constraint 11 and 9. In a similar manner joints 25*a, b, c* and d may be made adjustable with holes 27*a, b, c* and d and pins (not shown) in bars 7, 27, 29 and 31, respectively. In this way, the width of the device between constraints 3 and 5 may be adjusted to more accurately fit persons of different sizes.

In certain embodiments lateral sway constraint bars 3 and 5 are also adjustable height-wise. This may be done, for example, by a hole and pin arrangement as described above, but with respect to joints 31*a, c* as well as 33*a, c* and 35*a, c* as well (as shown in FIG. 1). In another alternative, not shown, the hole and pin adjustment may be made at the lower joints on the vertical bars corresponding to their upper sequel joints 13*a, c*; 33*a, c* and 35*a, c*, if desired. While back to front adjustment is possible, to add such is generally not necessary due to the length and pivotability of lower constraint 9, 11.

As an added, optional feature, a club retaining rack for horizontally resting clubs not being used may be provided as L-shaped tubes 37, 39 extending rearward of the frame and out of the way of a swinging golfer positioned within the cage. Still further, and with reference to FIGS. 3 and 4, while upright tubes 19*a*, 23*a* and 41*a* on one side of frame 1, as well as corresponding tubes 19*b*, 23*b* and 41*b* on the other side of frame 1 may be vertical, in preferred embodiments they are angled inwardly from bottom to top at an angle $\alpha$(see FIGS. 3 and 4). This brings the two lateral points of constraint to the point desired while assuring sufficient foot room for a proper stance in the base area 43 of frame 1.

Figure 8:
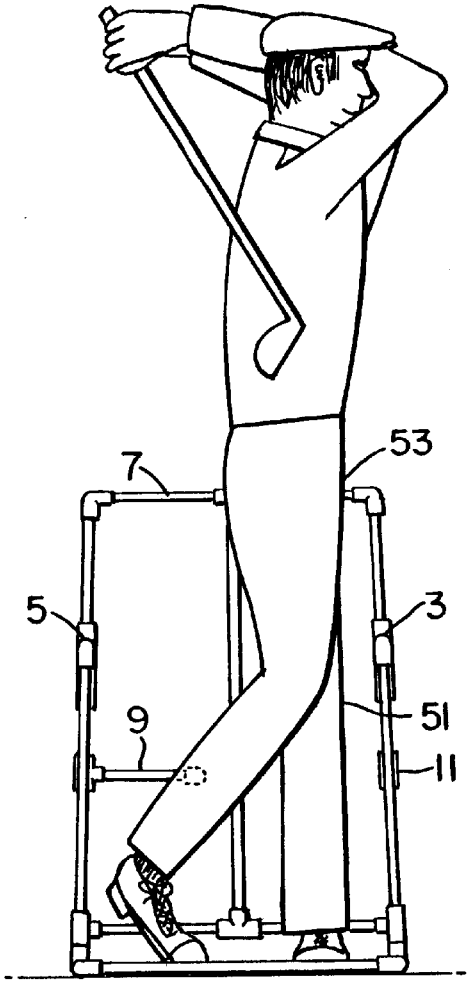
FIG. 8 is a front schematic view of the same golfer and device of FIG. 7 but with the golfer having completed his swing but having improperly come in contact with the forward restraint.
Figure 9:
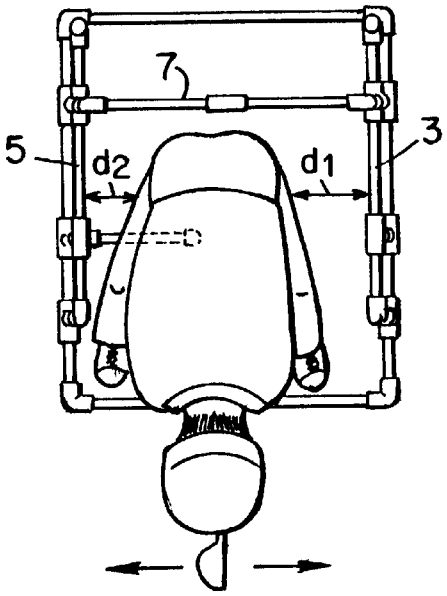
FIG. 9 is a top schematic view of the golfer in FIG. 6 shown in a proper pre-swing posture and position within the device of FIG. 1.

With reference now in particular to FIGS. 6–9, the positioning of the golfer for instruction in frame 1 with respect to the above-described constraints is illustrated generally schematically. In FIGS. 6 and 9 the golfer is shown in a proper position for initiating a golf swing. As can be seen, the rearward surface 45 of the golfer's buttocks is aligned so as to be proximal rear restraint bar 7 (or, alternatively, proximal vertical bar 7*a*, located centrally along bar 7). The term "proximal" is used herein to mean either actual contact with a constraint or just slightly removed therefrom. The preferred proximal position with respect to rear constraint 7, 7*a* is shown in FIGS. 6 and 9 as being proximal but not touching, so as to be within the range of about 3 inches or less from bar 7 (or 7*a*). As further shown in FIGS. 7 and 9 the golfer is located a generally, laterally centrally within frame 1 such that points "A" and "B" respectively, (points which are located between his knee 47 to his hip 49 of each leg) are in the horizontal plane "X" of constraints 3 and 5, respectively. As best shown in FIG. 9, points A and B are initially selected to be a preset spaced distance $d_1$ and $d_2$ from respective constraints 3 and 5. Spaces $d_1$, and $d_2$ may initially be equal (e.g., less than about 8 inches each) or may vary depending on the needs of the student. It is also noted here that the feet of the golfer are spaced so as not to contact any portion of the frame 1.

Still further, with respect to FIG. 6 (and 7), lower constraint 9 (here the golfer is a right handed swinging golfer) is located proximal (and here, in actual contact with) the rear of the golfer's lower rear leg in an area between the rear of the knee and his upper calf (and here directly at the rear of the knee). Lower constraint 11 has been pivoted out of the way. The term "proximal" is again defined here as above, and is used throughout this disclosure to mean either in direct contact with a constraint or just slightly removed therefrom (e.g., less than a few inches therefrom).

FIG. 7 now illustrates schematically the golfer in his backswing having properly maintained a quiet lower body by not overswaying rearwardly thereby avoiding contact with rearward constraint 5, which, through proper positioning, assures that the golfer will maintain the focus of his weight on the inner side of his rearward (right) foot (e.g., on the ball of his right big toe). Should the golfer come in contact with rearward constraint 5 he will immediately know that his swing is improper and that he should start again.

FIG. 8 now schematically shows the golfer at the end of his swing to have not contacted forward constraint 3 with the upper part of his left leg at a point between the knee 51 and hip 53. This means that he has not overswayed laterally. If, on the other hand, he had made contact with constraint 3, even though his back sway (FIG. 7) was properly executed, his follow through during the swing either before, during or after ball contact then caused him to oversway and thus not maintain a "quiet lower body". By now repeatedly practicing his swing between the posture shown in FIGS. 6–9 through a full finish as shown in FIG. 8, but without contacting forward constraint 3, the golfer will either be self taught, or under the guidance of an instructor, will learn to develop the modern "quiet lower body" golf swing with the correct balance and weight shift, as well as hip rotation so as to develop a more consistent, accurate and reliable swing.

Once given the above disclosure many other features, modifications, and improvement will become apparent to the skilled artisan. Such features, modifications and improvements are, therefore, considered a part of this invention, the scope of which is to be determined by the following claims.

I claim:

1. A golf swing instructional device comprising a frame member which includes at least three points of constraint for minimizing lateral movement of a golfer's lower body within preselected limits during a golf swing when said golfer is located within said frame member and as said golfer progresses through said golf swing, said points of constraint including:

a) a rear point of constraint;

b) a lower point of constraint; and c) a forward lateral point of constraint;

said points of constraint being so located each with respect to the other such that when said golfer assumes a proper posture to initiate a golf swing the said golfer's buttocks is located proximal said rear point of constraint and simultaneously therewith said lower point of constraint is located proximal a rear area of said golfer's rearward leg at a point located between his knee and upper calf and said forward lateral point of constraint is spaced a preselected lateral distance at a point located in a horizontal plane with said golfer's upper forward leg, such that a properly executed golf swing by said golfer so positioned will cause no portion of said golfer's upper forward leg between said golfer's forward hip and forward knee to contact said forward lateral point of constraint.

2. A golf swing instructional device according to claim 1 which further includes a rearward lateral point of constraint.

3. A golf swing instructional device according to claim 2 wherein said rearward lateral point of constraint is so located with respect to the other said points of constraint such that simultaneously with said golfer being in said position with respect to said other points of constraint, said rearward lateral point of constraint is spaced a preselected lateral distance at a point located in a horizontal plane from said golfer's upper rearward leg; such that a properly executed golf swing by said golfer so positioned will cause no portion of said rearward upper leg between said golfer's rearward hip and rearward knee to contact said rearward lateral point of constraint.

4. A golf swing instructional device according to claim 1 wherein said lower point of constraint is located in said rear area of said golfer's right leg.

5. A golf swing instructional device according to claim 1 wherein said lower point of constraint is located in said rear area of said golfer's left leg.

6. A golf swing instructional device according to claim 1 wherein said preselected lateral distance is less than 8 inches.

7. A golf swing instructional device according to claim 3 wherein said preselected lateral distance from said rearward lateral point of constraint is less than 8 inches.

8. A golf swing instructional device according to claim 1 wherein said frame member is adjustable so as to be capable of accommodating the said positions of said points of constraint to differently sized golfers.

9. A golf swing instructional device according to claim 1 wherein said frame member includes a lower right leg point of constraint and a lower left leg point of constraint, each said lower point of constraint being movable into and out of its said constraint position.

10. A golf swing instructional device according to claim 1 wherein said device includes a rearward lateral point of constraint and wherein said rearward and forward lateral points of constraint are connected one to the other by said rear point of constraint.

11. A golf swing instructional device according to claim 1 wherein said device is provided with means for retaining at least one golf club when said golf club is not in use by said golfer.

12. A method of instructing a golfer to perform a proper golf swing with minimized lower body lateral motion, the steps including:

a) providing at least three constraints for positioning a golfers body in relation thereto such that when so positioned the golfer assumes the proper posture for initiating a golf swing, said points of constraint including a rear point of constraint, a lower point of constraint, and a forward lateral point of constraint;

b) positioning said golfer in said proper posture such that his buttocks is located proximal said rear constraint, an area at the rear of his rearward leg between his knee and upper calf is located proximal said lower constraint and the forward lateral surface of the upper leg of said golfer's forward leg at a point between said golfer's hip and knee of said forward leg is spaced a preselected distance from said forward lateral constraint; and c) performing a golf swing by said golfer when in said position and at said proper posture without contacting said forward lateral constraint at any time throughout said swing thereby to have engaged in a golf swing with said minimized lower body motion.

13. A method according to claim 12 which includes providing a rearward lateral constraint, positioning said golfer such that the rearward lateral surface of his rearward upper leg at a point between his hip and knee is spaced a preselected distance from said rearward lateral constraint and when performing said golf swing when in said position and at said proper posture the said upper rearward leg of said golfer does not contact said rearward lateral constraint at any time throughout said swing.

14. A method according to claim 13 wherein said rearward lateral constraint and said forward lateral constraint are in substantially the same horizontal plane.

15. A method according to claim 14 wherein said forward and rearward upper leg of said golfer remains in substantially the same horizontal plane of said rearward and forward lateral constraint throughout the golf swing.

16. A method according to claim 12 wherein said forward lateral constraint is in substantially the same horizontal plane as the forward upper leg of the golfer when said golfer is in said proper posture before initiating said golf swing.

17. A method according to claim 12 wherein said step of positioning said golfer in said proper position includes positioning said golfer's buttocks so as to be in contact with said rear constraint.

18. A method according to claim 17 wherein said step of positioning said golfer in said proper position includes positioning said area of the rear of said rearward leg in contact with said lower constraint.

19. A method according to claim 18 wherein said step of positioning said golfer in said proper position includes positioning said rear and forward hips of said golfer such that their respective preselected distance from their respective lateral constraint are substantially the same.

* * * * *